United States Patent [19]

Vockensperger et al.

[11] Patent Number: 4,805,534

[45] Date of Patent: Feb. 21, 1989

[54] AMMUNITION EJECTION DEVICE

[75] Inventors: Hubert Vockensperger, Feldkirchen-Westerham; Franz Hieble, Neu-Ulm; Robert Gebbhardt, Poing, all of Fed. Rep. of Germany

[73] Assignee: Bayern-Chemie Gesellschaft für flugchemische Antriebe mbH, Fed. Rep. of Germany

[21] Appl. No.: 92,058

[22] Filed: Sep. 1, 1987

[30] Foreign Application Priority Data

Sep. 4, 1986 [DE] Fed. Rep. of Germany ..... 3630083

[51] Int. Cl.[4] ..... F42B 13/50

[52] U.S. Cl. ..... 102/489; 102/202; 102/530

[58] Field of Search ..... 102/489, 530, 531, 202, 102/204, 340, 342, 351, 357

[56] References Cited

U.S. PATENT DOCUMENTS 1,140,041 5/1915 Karlik .
3,062,147 11/1962 Davis et al. .
3,667,391 6/1972 Amiable et al. .
3,726,223 4/1973 Moe .
4,558,645 12/1985 Boeder et al. .
4,714,020 12/1987 Hertsgaard et al. .

FOREIGN PATENT DOCUMENTS 2920347 11/1980 Fed. Rep. of Germany ..... 102/489
3026159 8/1982 Fed. Rep. of Germany ..... 102/489

*Primary Examiner*—Deborah L. Kyle
*Assistant Examiner*—Richard Klein
*Attorney, Agent, or Firm*—McGlew and Tuttle

[57] ABSTRACT

A device for ejecting ammunition containers from a war head has, transversely to the war head longitudinal axis a bellows which accepts individual ammunition containers in concave circumferentially sparse pockets (6). The bellows is inflated by a gas-generator including a gas-permeable tube extending along the longitudinal axis. In order to achieve as wide a variation range of ejection behavior of the ammunition container as possible, the propellant charge of the gas generator is particulate and at least one ITLX ignition cord extends along the longitudinal axis of the tube, so that the hot particles during burndown of the ITLX ignition cord are pressed between the particles of the propellant charge (12). A damming serves to build up the initial pressure required for the burn-down of the propellant charge.

11 Claims, 2 Drawing Sheets

AMMUNITION EJECTION DEVICE

BACKGROUND OF THE INVENTION

FIELD OF THE INVENTION

The invention relates in general to ammunition handling and in particular to a new and useful device for ejecting containers, in particular of ammunition from a war head or similar holder.

A similar device is shown in German patent DEP No. 30 26 159. The gas generator has a massive solid propellant charge in a gas-permeable tube in the center of the bellows and thus, with respect to the ejection behavior of the container to be ejected, in practically nonvariable.

SUMMARY OF THE INVENTION

The invention permits the ejection of a container in a variable and a simple manner over a wide range.

In the device according to the invention the gas generator comprises a gas-permeable tube preferentially dammed up with a film, built, for example, as a spray tube, into which the particulate preferentially platelet-like propellant charge preferentially of a double base propellant substance is filled.

The geometry of the openings of the gas-permeable tube is adapted to the propellant charge, in order to gain the desired constriction, e.g. the desired ratio of the overall area of all openings of the gas-permeable tube to its surface. The propeellant charge is ignited by at least one pyrotechnic ignition cord, which lies in the center axis of the gas-permeable tube and extends over the entire length of the gas generator tube and which contains a mixture of an oxygen releasing compound, like potassium or ammonium chlorates, as well as a metal powder like aluminum powder, possibly with additions, like a plastic binding agent. It is thus a mixture, which corresponds approximately to a compound propelling charge. Particularly suitable are socalled ITLX (ignition thin layer x-cord).

The use of such ignition cords leads to a simple structure of the ignition chain with high reliability. This ignition cord can also be mechanically loaded and leads to a slight spraying during ejection of the ammunition containers. By approximately adjusting these components (streaming-out openings of the gas-permeable tube, constriction, propellant charge geometry, pyrotechnic ignition cord) not only the ignition and the function of the gas generator can be controlled, but with it also the effect of the ejection device with respect to the ejection behavior of the containers in particular containing ammunition.

Accordingly, it is an object of the invention to provide a device for ejecting containers particularly ammunition of a warhead which comprises a gas permeable tubular gas generator having an ignitable propellant powder and a propellant ignition wire extending lengthwise in the tubular generator comprising an oxygen releasing material and a metal powder and further including an expandable bellows member disposed around the gas generator and forming a plurality of longitudinally extending and circumferentially arranged pockets when open radially in respect to the tubular generator and including a container such as an ammunition container in each of the pockets which are hurled radially outwardly when the bellows is expanded and which also includes a film damming the gas permeable tubular generator which is openable by generator propellant gases upon ignition thereof to inflate and expand the bellows.

A further object of the invention is to provide a device which includes a bellows forming pockets containing ammunition having a central gas permeable tubular gas generator which includes a film of a burnable material inclosing its interior and damming the interior up which is removable upon generation of the gases in said tubular generator.

A further object of the invention is to provide a device which is simple in design, rugged in construction and economical to manufacture.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which preferred embodiments of the invention are illustrated.

GENERAL DESCRIPTION OF THE PREFERRED EMBODIMENTS

Figure 1:
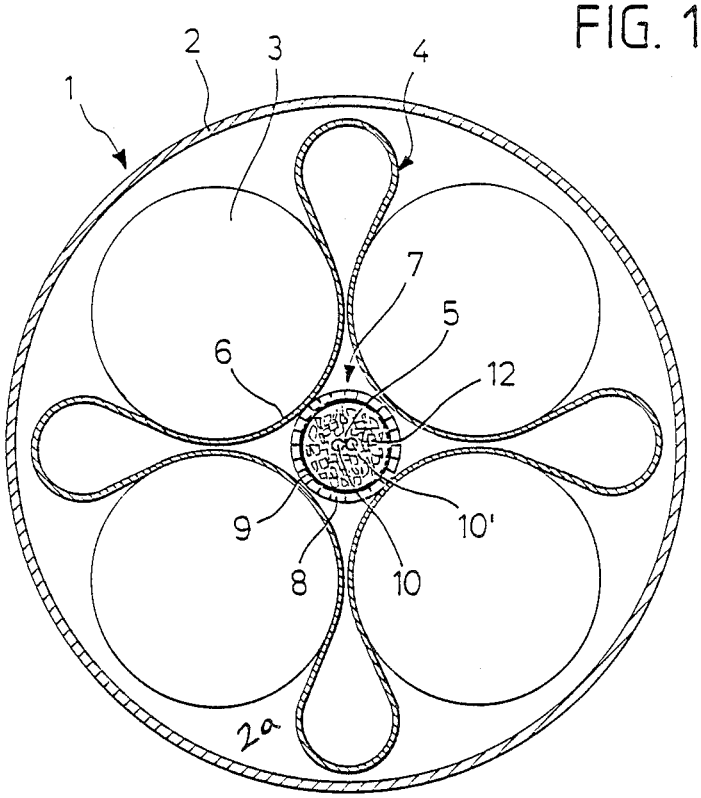
FIG. 1 is a cross section of a war head constructed in accordance with the invention.

Referring to the drawings in particular the invention as embodied therein, as shown in FIG. 1 comprises a device for ejecting particularly ammunition charges which includes a war head 1 having a spray ammunition in a plurality of containers designated 3 which are arranged in pockets formed by a flexible bellows member 4 which open radially outwardly.

The bellows 4 is arranged concentrically to a longitudinal axis 5 of the war head 1. The bellows 4 has concave wells as directed toward the longitudinal axis 5 forming pockets 6, into which individual containers of spray ammunition 3 are placed. The two frontal sides or ends of the bellows 4 are covered by bulkhead plates (not shown). When pressurizing the bellows 4 from within with pressure gas, it forms a cylinder, i.e. the pockets 6 are rapidly turned inside out at high velocity and the spray ammunition containers 3 are ejected in the process. Instead of four, three pockets 6 can also be provided, for example.

Pressurization of the bellows 4 is effected by a gas generator 7 which comprises a spray tube 8, which is dammed up on its interior wall with a polyethylene film 9. Two ignition cords 10, 10' extend along the entire longitudinal axis 5 in the center of the tube 8.

Figure 4:
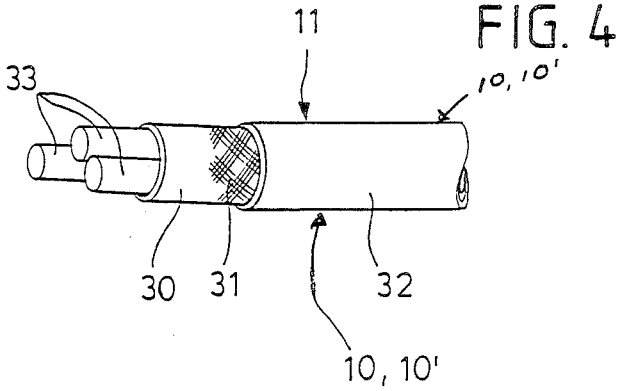

The ignition cords 10, 10' are formed by ITLX ignition cords. According to FIG. 4, such ignition cord comprises a tubing 11 of an interior tubing layer 30 of a synthetic material, for example polyethylene, a reinforcement layer 31 of a fiber mesh, for example fiber glass, and an outer jacket 32 of a synthetic material, for example, of polyethylene. In the tubing 11 three ropes 33 are arranged, which consist of a mixture of potassium perchlorate, ammonium perchlorate and aluminum powder, bound with polyethylene acrylate.

An ignition cord of this nature has a high propagation rate with a hot particle-rich flame, and the flame front, which propagates in the ropes 33 leads to a decomposition of the tubing 11.

Figure 3:
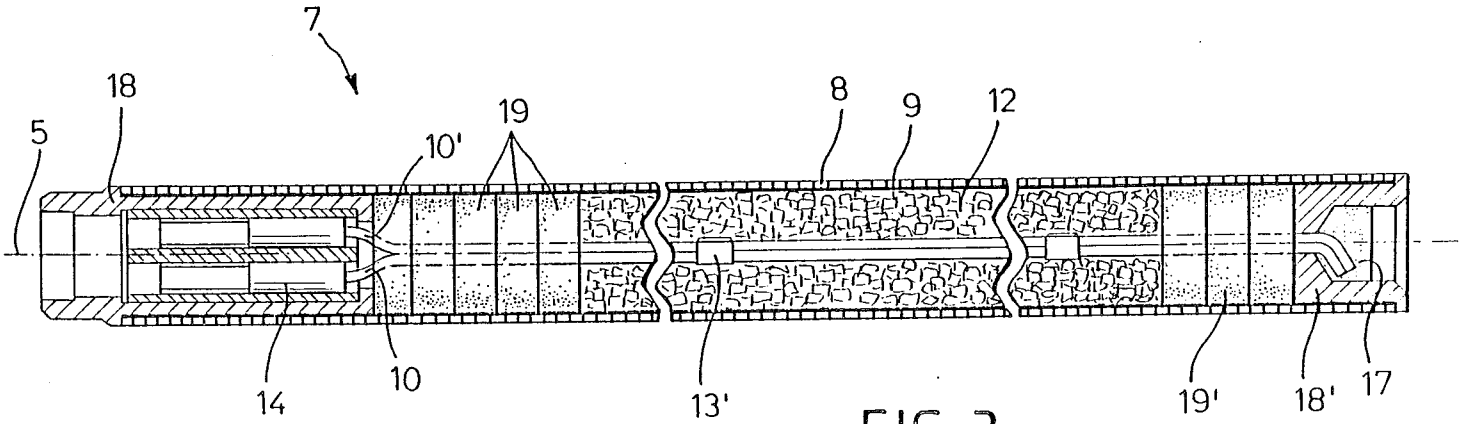
FIG. 3 is a partially enlarged logitudinal section corresponding to FIG. 2; and, FIG. 4 is a partial front end perspective view partly broken away of an ITLX ignition cord with cut-off parts.

If several ignition cords 10, 10' are used, as shown in FIG. 3, they are held together by straps 13'.

The propellant charge 12 includes platelets and is located in the space between the ignition cords 10, 10'. The gas generator 7 is dammed up with the damming film 9.

The propellant charge 12 comprises for example, a double base propellant.

As shown on FIG. 3, delay elements 14 are integrated with the ignition cords 10, 10' and the firing can be initiated by an amplification charge (not shown).

The closing parts 18, 18' close the spray tube 8 at both ends. In the closing part 18' the other end of the ignition cords 10, 10' is fastened, for example with adhesive 17. Furthermore, on the ignition cords 10,10' inert bodies, for example, in the form of rings 19, 19' of a synthetic foamed material are provided, for example between the propellant charge 12 and the delay element 14, as well as at the other ends of the tube 8.

For ejecting the spray ammunition 3, the war head cover 2 is initially removed, for example through rip cords (not shown). Subsequently, delayed by the delay element 14, the ignition cord 10, 10' is ignited. The ITLX ignition cords 10, 10' lead to the formation of a hot, particle-rich flame. The hot particles are pressed between the platelets of the propellant charge 12 in order to ignite them. In this way the ignition of the propellant charge 12 takes place simultaneously over the entire length with corresponding rapid and controllable pressure built-up.

Damming up respectively the film 9 is necessary because a sufficiently high pressure and a sufficiently high temperature is required in order to ignite the propellant charge 12.

On the other hand, opening the damming 9 leads to a sudden pressure drop. The hot particles of the ITLX ignition cord 10, 10' have accordingly not only the function to effect the ignition of the propellant charge 12, rather it also prevents the propellant charge 12 from becoming extinguished after the opening of the damming 9.

Through the described structure of the gas generator 7, thus a rapid and uniform build-up in the bellows 4 can be achieved and with it a high ejection acceleration of the spray ammunition 3.

One essential advantage or the device according to the invention is that the ejection acceleration of the ejection behavior of the spray ammunition can be adapted relatively easily to the given demands and can be varied over the length of the bellows. Apart from the constriction, e.g. the ratio of the overall area of the opening of the spray tube 8 to its surface, the nature of the damming and the kind and amount of the ignition cords 10, 10', this can take place through the kind and amount of the propellant substance, as well as the configuration of the propellant charge 12 and its axial distribution.

Figure 2:
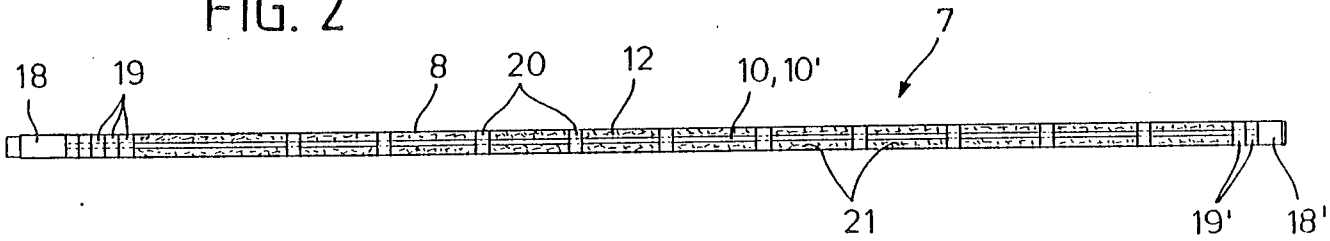
FIG. 2 is a partial longitudinal sectional view of the gas generator.

In particular, it is possible according to FIG. 2, to separate the propellant charge 12 by radially extending partition walls 20 of inert material at axial distances from each other, between the ignition cords 10, 10' and the tube 9 into individual segments or circular chambers 21. The partition walls 20 can be of, for example, synthetic foamed material rings.

Into each of these chambers 21, specifically a given amount of propellant substance can be placed, for example, in order to achieve uniform distribution of a given propellant substance amount along the tube 8.

Along the tube 8 several bellows 4 separated by a bulkhead plates can also be arranged in succession behind each other, each loaded with spray ammunition, with the ejection behavior of the spray ammunition of the individual bellows 4 being controllable in a similar way, for example, through the propellant charge amount intended for each bellows 4 in the gas generator 7, but also through further pyrotechnic delay elements integrated into the ignition cord 10, 10'. The thereby created ignition units with the coresponding kind, amount and distribution of the propellant charge 12 in a single tube 8 can be arranged separately, for example, from each other by partition walls or bulkhead plates or several separate complete gas generators 7 and they can be arranged in the war head longitudinal axis 5 in a row behind each other.

While specific embodiments of the invention have been shown and described in detail to illustrate the application of the principles of the invention, it will be understood that the invention may be embodied otherwise without departing from such principles.

What is claimed is:

1. A device for ejecting containers, in particular containers of ammunition from a war head, comprising, a longitudinally extending bellows with first and second ends and having a longitudinal axis said longitudinally extending bellows forming longitudinally extending circumferentially arranged open pockets around said longitudinal axis, a container in each of said pockets, bulkhead means for closing said bellows at each end, a gas generator for inflating the bellows including a gas permeable tube arranged in the interior of said bellows and extending substantially the length of said bellows, a solid propellant charge in said gas permeable tube of a particulate material said propellant charge being subdivided into individual chambers formed of a plurality of radially extending partition walls dividing said gas-permeable tube into said chambers, said chambers being arranged along the longitudinal axis and being each filled with said particulate material, a film for damming up said gas permeable tubes arranged within said gas permeable tube toward the outside of said propellant charge and being consumable so that upon being pressurized said propellant gases flow to the outside of said gas permeable tube, and igniting means for igniting the propellant charge extending over a substantial portion of the length of said propellant charge said ignition means comprises a mixture of a perchlorate oxygen releasing compound and a metal powder comprising at least one of boron, aluminum and magnesium.

2. A device according to claim 1 wherein, said igniting means comprises a ignition cord, the particles of such propellant charge being formed as platelets.

3. A device according to claim 2 wherein, said ignition cord comprises an ITLX ignition cord.

4. A device according to claim 2 wherein, said ignition cord comprises a pyrotechnic delay element.

5. A device according to claim 1 wherein, said propellant charge comprises a double based propellant substance.

6. A device according to claim 1, wherein: said ignition means comprises: a plurality of ignition rope elements formed of a mixture comprising potassium perchlorate, ammonium perchlorate and aluminum powder.

7. An ammunition container ejection device, comprising a central gas permeable tube gas generator, an ignitable propellant powder in said tubular gas generator said propellant charge being sub-divided into individual chambers, a plurality of radially extending partition walls dividing said gas-permeable tube into said chambers arranged along the longitudinal axis, propellant ignition means extending through substantially the length of said gas permeable tube and including an oxygen releasable burnable material and a metal powder, and expandable bellows member disposed around said gas generator and forming a plurality of longitudinally extending and circumferentially arranged pockets each opening radial outwardly in respect to said tubular gas generator, an ammunition container in each of said pockets which are hurled upwardly by said bellows when said bellows is expanded, and openable film means positioned within said gas permeable tubular gas generator for damming said gas permeable gas generator and being openable by generator propellant gases upon ignition thereof to inflate and expand said bellows.

8. A device according to claim 7 wherein, said metal powder comprising at least one of boron, aluminum and magnesium.

9. A device according to claim 7 wherein, said oxygen releasing compound is a perchlorate.

10. A device for ejecting containrs, in particular containers of ammunition from a war head, comprising, a longitudinally extending bellows with first and second ends and having a longitudinal axis said longitudinally extending bellows forming longitudinally extending circumferentially arranged open pockets around said longitudinal axis, a container in each of said pockets, bulkhead means for closing said bellows at each end, a gas generator for inflating the bellows including a gas permeable tube arranged in the interior of said bellows and extending substantially the length of said bellows, a solid propellant charge in said gas permeable tube of a particulate material, a film for damming up said gas permeable tubes arranged within said gas permeable tube toward the outside of said propellant charge and being consumable so that upon being pressurized said propellant gases flow to the outside of said gas permeable tube, said film being formed of synthetic film arranged on the interior wall of said gas permeable tube, and igniting means for igniting the propellant charge extending over a substantial portion of the length of said propellant charge said ignition means comprising a mixture of an oxygen releasing compound and a metal powder.

11. A device according to claim 10, wherein said synthetic film comprises a polyethylene.

* * * * *